US008185232B2

(12) United States Patent
Higo et al.

(10) Patent No.: US 8,185,232 B2
(45) Date of Patent: May 22, 2012

(54) LEARNING METHOD OF ROLLING LOAD PREDICTION FOR HOT ROLLING

(75) Inventors: Tsuyoshi Higo, Tokyo (JP); Yosuke Mizoguchi, Tokyo (JP); Kazutsugu Igarashi, Tokyo (JP); Yasushi Fukuoka, Tokyo (JP)

(73) Assignee: Nippon Steel Corporation, Tokyo (JP)

( * ) Notice: Subject to any disclaimer, the term of this patent is extended or adjusted under 35 U.S.C. 154(b) by 17 days.

(21) Appl. No.: 12/451,037

(22) PCT Filed: Mar. 12, 2009

(86) PCT No.: PCT/JP2009/055364

§ 371 (c)(1), (2), (4) Date: Oct. 22, 2009

(87) PCT Pub. No.: WO2009/113719

PCT Pub. Date: Sep. 17, 2009

(65) Prior Publication Data

US 2010/0121471 A1 May 13, 2010

(30) Foreign Application Priority Data

Mar. 14, 2008 (JP) ..... 2007-066712

(51) Int. Cl.

| | |
|---|---|
| ***G06F 19/00*** | (2006.01) |
| ***B21B 37/00*** | (2006.01) |
| ***B21B 23/00*** | (2006.01) |
| ***B21D 55/00*** | (2006.01) |
| ***B21D 31/00*** | (2006.01) |

(52) U.S. Cl. ..... 700/148; 700/104; 700/150; 700/155; 72/9.2; 72/9.4; 72/11.8; 72/16.9; 72/18.8; 72/362; 72/364; 72/365.2; 72/366.2

(58) Field of Classification Search ..... 700/104, 700/148, 150, 155; 72/9.2, 9.4, 11.8, 16.9, 72/18.8, 362, 364, 365.2, 366.2
See application file for complete search history.

(56) References Cited

U.S. PATENT DOCUMENTS 3,713,313 A * 1/1973 Spradlin ..... 72/10.4
4,512,169 A * 4/1985 Miura ..... 72/9.2

(Continued)

FOREIGN PATENT DOCUMENTS

JP 50-108150 8/1975

(Continued)

OTHER PUBLICATIONS

International Search Report dated Jun. 16, 2009 issued in corresponding PCT Application No. PCT/JP2009/055364.

(Continued)

*Primary Examiner* — Albert Decady
*Assistant Examiner* — Jason Lin
(74) *Attorney, Agent, or Firm* — Kenyon & Kenyon LLP

(57) ABSTRACT

The present invention provides a learning method of rolling load prediction which uses a prediction error of a rolling load at an actual pass of a stock in hot rolling to correct a predicted value of rolling load at a subsequent rolling pass. The method comprises changing a gain for multiplying with the prediction error of the rolling load at the actual pass in accordance with a thickness of the stock to thereby set the learning coefficient of the rolling load prediction and improve the precision of the prediction.

11 Claims, 5 Drawing Sheets

U.S. PATENT DOCUMENTS

| | | | | |
|---|---|---|---|---|
| 5,761,066 | A * | 6/1998 | Lettau et al. | 700/155 |
| 5,960,657 | A * | 10/1999 | Anbe et al. | 72/9.1 |
| 6,014,881 | A * | 1/2000 | Imanari | 72/201 |
| 6,377,864 | B1 * | 4/2002 | Lindstrom | 700/96 |
| 6,526,328 | B1 * | 2/2003 | Maguin et al. | 700/148 |
| 6,839,605 | B2 * | 1/2005 | Park et al. | 700/155 |
| 7,031,797 | B2 * | 4/2006 | Reinschke et al. | 700/150 |
| 7,751,923 | B2 * | 7/2010 | Koenig et al. | 700/129 |
| 2004/0153196 | A1 * | 8/2004 | Park et al. | 700/148 |
| 2005/0004695 | A1 * | 1/2005 | Cribbs et al. | 700/104 |
| 2006/0207305 | A1 * | 9/2006 | Maruyama et al. | 72/9.3 |

FOREIGN PATENT DOCUMENTS

| | | | |
|---|---|---|---|
| JP | 61-235017 | | 10/1986 |
| JP | 01-133606 | | 5/1989 |
| JP | 08-052506 | | 2/1996 |
| JP | 8-52506 | | 2/1996 |
| JP | 08052506 | A * | 2/1996 |
| JP | 10-216812 | | 8/1998 |
| JP | 10216812 | A * | 8/1998 |
| JP | 10-263640 | | 10/1998 |
| JP | 2000-126809 | | 5/2000 |
| JP | 2006-095592 | | 4/2006 |
| JP | 2006-95592 | | 4/2006 |
| JP | 2007-891 | | 1/2007 |
| JP | 2007-000891 | | 1/2007 |
| JP | 2007000891 | A * | 1/2007 |

OTHER PUBLICATIONS

Chinese Office Action dated Mar. 31, 2011 issued in corresponding Chinese Patent Application.

Li Weiming et al., "An Adaptive Algorithm Used for Interpass in Medium and Heavy Plate Rolling", Steel Plate vol. 7, No. 6, Jun. 30, 2001 [with English Translation].

"Model and Control Technique for Continuous hot-rolling of steel sheet (§6.2.4 - §6.4.2.3)" Metallurgical Industry Press, Oct. 31, 2002 [with English Translation].

Liang Guoping "The Optimum Distribution of Loads on Rolling Mills" Iron and Steel, vol. 15, No. 1, Jan. 31, 1980 [with English Translation].

* cited by examiner (a)

(b)

LEARNING METHOD OF ROLLING LOAD PREDICTION FOR HOT ROLLING

This application is a national stage application of International Application No.

PCT/JP2009/055364, filed 12 Mar. 2009, which claims priority to Japanese Application No. 2008-066712, filed 14 Mar. 2008, which is incorporated by reference in its entirety.

TECHNICAL FIELD

The present invention relates to a learning method of rolling load prediction for hot rolling.

BACKGROUND ART

When rolling a stock to a desired thickness, in general two or more rolling passes are used to obtain the thickness of the rolled material close to the desired thickness. At this time, a target value of the delivery thickness at each pass is given and the rolling force, rolling torque, and other rolling load at each pass when achieving this are predicted. Furthermore, it is becoming necessary to estimate the mill stretch, roll deflection, and other elastic deformation amounts of the rolling mill based on these predicted values and set the roll gaps and crown control amounts so as to compensate for these and to estimate the power and set the rolling speed so that these satisfy allowable ranges, then perform the rolling.

At this time, a prediction formula using the components, dimensions, temperature, rolling conditions, etc. of the stock as parameters is used so as to predict the rolling load, but error in prediction of the rolling load sometimes occurs due to the low precision of the prediction formula used and error between the settings (predicted values) of the parameters inputted into the prediction formula and the actual values. For this reason, so-called "inter-pass learning" has been performed using prediction error of the rolling load in an already performed rolling pass to correct the predicted values of rolling load for subsequent rolling passes.

As the most general inter-pass learning method, there is the method of using a prediction error rate of rolling load at a previous pass (actual pass) to set a learning coefficient $C^F$ of rolling force prediction for a rolling pass of the stock to be performed from then on (predicted pass).

For example, if considering the rolling force as the rolling load, the ratio $C^P$ between the actual value of the rolling force $P^{exp}$ at an actual pass for the stock and the predicted value $P^{cal}$ of the rolling force at a rolling force model for that actual pass is considered as an indicator of the prediction error of the rolling force at an actual pass (hereinafter referred to as the "prediction error rate").

$$C^P = \frac{P^{exp}}{P^{cal}} \tag{1}$$

In this regard, in general, the trend in prediction error of the rolling load in actual passes is not always constant for different passes even for the same stock. For example, often the error indicator $C^P$ of rolling load prediction in an actual pass found by formula (1) is multiplied with a gain $\alpha$ to flatten the trend in prediction error of the rolling load so as to set the learning coefficient $C^F$ for rolling force prediction at the predicted pass.

At this time, if making the gain $\alpha$ excessively large, the prediction error will tend to easily disperse, while if making the gain $\alpha$ excessively small, the prediction error of the rolling load will be harder to converge. To stably raise the precision of rolling load prediction by the present art, it is essential to set a suitable gain $\alpha$.

Therefore, for example, Japanese Patent Publication (A) No. 50-108150 discloses the art of setting the learning coefficient $C^F$ of rolling force prediction at a predicted pass at which time, when the prediction error of the rolling load at the actual pass would be near the average value of past results, increasing the gain $\alpha$ multiplied with the prediction error of the rolling load at the actual pass and, when not, setting said gain $\alpha$ small so as to improve the precision of the rolling load prediction.

However, in general, the prediction error of the rolling load at an actual pass is distributed over a wide range, so with the method of adjusting the gain $\alpha$ to be multiplied with the error of the rolling load prediction in an actual pass in accordance with the error from the average value of the past results of the prediction error of the rolling load at an actual pass so as to set the learning coefficient $C^F$ of the rolling force prediction at the predicted pass, it is difficult to stably raise the precision of the rolling load prediction.

Japanese Patent Publication (A) No. 2000-126809 discloses the art of expressing the prediction error of the rolling load by a weighted sum of the prediction error of the friction coefficient and the prediction error of the material deformation resistance and correcting the respective weighting coefficients at each pass so as to thereby improve the prediction precision of the rolling load.

Japanese Patent Publication (A) No. 1-133606 discloses the art of using weighting coefficients showing the degrees of effect of the different parameters of a rolling load prediction formula on the rolling load so as to determine the learning coefficient for rolling load prediction to thereby improve the precision of the rolling load prediction.

Japanese Patent Publication (A) No. 10-263640 discloses the art of separating the learning coefficient for rolling load prediction into a component for correction of error distinctive to the rolling material and a component for correction of error due to aging of the rolling mill to thereby improve the precision of the rolling load prediction.

In this way, in art for correcting the prediction error of the rolling load based on envisioned error factors, if the envisioned error factors match with the actual situation, the precision of the rolling load prediction can probably in principle be improved.

However, the error factors of the rolling load include various factors such as the surface conditions of the stock and rolling rolls, the temperature and deformation characteristics of the stock, the precision of setting the rolling conditions, etc. It is extremely difficult to logically extract and estimate error of this large number of influencing factors.

That is, in the past, in rolling, no learning method could be found using the prediction error of the rolling load at an actual pass to correct the predicted value of rolling load at subsequent rolling passes and thereby stably improve the precision of the rolling load prediction.

SUMMARY OF INVENTION

In the above way, in the past, in rolling, no learning method of rolling load prediction could be found using the prediction error of the rolling load at an actual pass of a stock to correct the predicted value of the rolling load at subsequent rolling passes of the stock and thereby stably improve the precision of the rolling load prediction. Such a learning method has been desired.

The present invention was made in consideration of the above problems and has as its object the provision of a learning method of rolling load prediction for hot rolling using the prediction error of the rolling load at an actual pass of a rolling material to correct the predicted value of the rolling load at subsequent rolling passes to thereby stably improve the precision of the rolling load prediction.

To achieve the above object, we, the inventors, engaged in numerous studies regarding the relationship between the actual value of the rolling load and the calculated value and prediction error.

Note that, here, the "rolling load" indicates the rolling force, the rolling torque, the rolling power, etc. Further, the calculated value of the rolling load is the rolling force, obtained by entering the actual values of the rolling conditions in an actual pass into a prediction formula of the rolling force, multiplied with the learning coefficient of the rolling force prediction for that pass.

As a result of the studies, we discovered that in hot rolling, whether or not the error between the actual value of the rolling load and the calculated value will not change much even with repeated rolling passes is greatly influenced by the magnitude of the thickness of the stock.

Therefore, we studied this further whereupon they found that in rolling load prediction, by changing the gain multiplied with the prediction error of the rolling load at an actual pass in accordance with the thickness of the stock, it is possible to stably improve the precision of the rolling load prediction and thereby completed the present invention.

In addition, we discovered that the smaller the thickness of the stock, the easier it is for the error between the actual value of the rolling load and the calculated value to change along with repeated rolling passes, so learned that making the gain for the prediction error of the rolling load at an actual pass smaller, the smaller the thickness of the stock is preferable for improvement of the precision of the rolling load prediction.

That is, this is believed to be because, in hot rolling, when the thickness is great, the temperature of the stock does not change much, so even if repeating rolling passes, the temperature estimation error of the stock will not change that much. For this reason, the change of the precision of the temperature prediction of the stock, which has a large effect on the precision of the rolling load prediction, is small, so it is believed that the error between the actual value of the rolling load and its calculated value will not change much even if repeating rolling passes.

On the other hand, if the thickness is small, the temperature of the stock will greatly change along with the repeated rolling passes, so it is believed that the error between the actual value of the rolling load and its calculated value will easily change along with repeated rolling passes.

That is, we discovered that the greater the thickness of the stock at the actual pass referred to, the more resistant the error between the actual value of the rolling load and its calculated value to change, so learned that making the gain multiplied with the prediction error of the rolling load at an actual pass referred to larger, the greater the thickness of the stock at that actual pass is preferable for improving the precision of the rolling load prediction.

Further, we discovered that the smaller the thickness of the rolling material at the predicted pass concerned, the smaller the effect of the prediction error of the rolling load at an actual pass on the prediction error of the rolling load at that predicted pass, so learned that making the gain multiplied with the prediction error of the rolling load at an actual pass smaller, the smaller the thickness of the stock at the predicted pass covered is preferable for improving the precision of the rolling load prediction.

Furthermore, we discovered that the thickness serving as the reference for changing the gain multiplied with the prediction error of the rolling load at an actual pass should be set based on one or more of the entry thickness, delivery thickness, and average thickness in combination.

The present invention was made based on the above findings and has as its gist the following:

(I) A learning method of rolling load prediction for hot rolling referring to prediction error of a rolling load at an actual pass of a stock to correct a predicted value of rolling load at a rolling pass of the stock to be performed from then on, the learning method of rolling load prediction for hot rolling characterized by, when setting a learning coefficient for rolling load prediction, changing the gain multiplied with the prediction error of the rolling load at the actual pass in accordance with a thickness of the stock.

(II) In the learning method of rolling load prediction as set forth in (I), the gain multiplied with the prediction error of the rolling load at the actual pass may be set so as to become smaller, the smaller the thickness of the stock.

(III) In the learning method of rolling load prediction as set forth in (I) or (II), the gain multiplied with the prediction error of the rolling load at the actual pass may be changed in accordance with the thickness of the stock at an actual pass.

(IV) In the learning method of rolling load prediction as set forth in (I) or (II), the gain multiplied with the prediction error of the rolling load at the actual pass may be changed in accordance with the thickness of the stock at the predicted pass.

(V) In the learning method of rolling load prediction as set forth in (I) or (II), the gain multiplied with the prediction error of the rolling load at the actual pass may be changed in accordance with the thickness of the stock at a final pass.

(VI) In the learning method of rolling load prediction as set forth in any one of (I) to (V), the thickness used as the reference for changing the gain multiplied with the prediction error of the rolling load at the actual pass may be changed from one obtained from one or more of an entry thickness, delivery thickness, and average thickness in combination.

(VII) In the learning method of rolling load prediction as set forth in any one of (I) to (VI), a rolling force may be used as the rolling load for prediction.

(VIII) In the learning method of rolling load prediction as set forth in any one of (I) to (VII), a rolling torque may be used as the rolling load for prediction.

Next, the advantageous effects according to the present invention will be explained.

According to the aspect of the invention of the above (I), compared with the prior art, learning in rolling load prediction can be realized enabling an improvement of the precision of the rolling load prediction in hot rolling.

Furthermore, according to the aspect of the invention of the above (II), learning in rolling load prediction can be realized enabling stable improvement of the precision of the rolling load prediction.

Further, according to the aspects of the invention of the above (III) to (VI), furthermore learning in rolling load prediction can be realized enabling stable improvement of the precision of the rolling load prediction.

In addition, according to the aspect of the invention of the above (VII), the precision of the rolling force prediction can be stably improved, so it is possible to precisely estimate the mill stretch, roll deflection, and other elastic deformation of the rolling mill, set the roll gap and crown control amount so as to compensate for this, and thereby improve the precision of thickness, crown, and flatness of the stock.

Further, according to the aspect of the invention of the above (VIII), the precision of the rolling force prediction can be stably improved, so it is possible to precisely estimate the power, set the rolling speed so that this satisfies an allowable range and thereby improve the productivity.

In the above way, according to the present invention, in hot rolling, it is possible to more stably improve the precision of the rolling load prediction compared with the past. Further, due to this, it is possible to make the thickness, crown, and flatness of the rolled products closer to the desired values, so the effects are also obtained that the yield loss in rolling is suppressed and the productivity is improved.

BRIEF DESCRIPTION OF THE DRAWINGS

FIG. 3(*b*) is a graph showing the precision of the rolling torque prediction, when predicting the rolling torque as the rolling load, in Example 1 of the present invention.

EMBODIMENTS OF INVENTION

Figure 1:
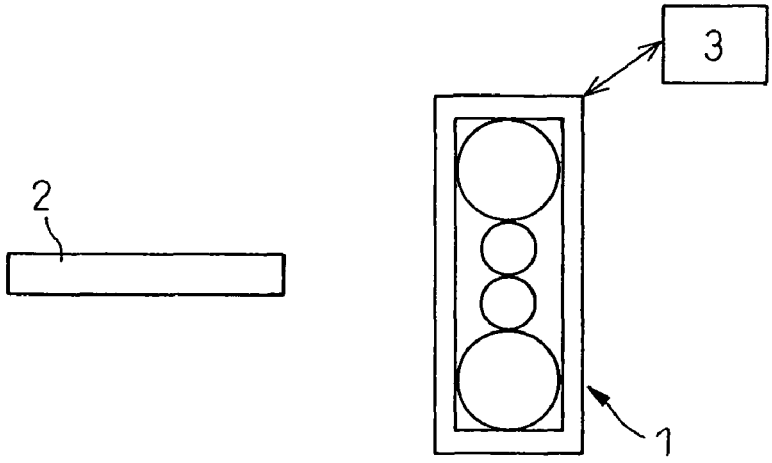
FIG. 1 is a view showing a rolling line used for Examples 1 and 2 of the present invention.

Embodiments of the present invention will be explained using an example.

This art is art able to be applied to prediction of all sorts of rolling load indicators such as the rolling force and the rolling torque. Here, as a preferred embodiment of the present invention, the example of the rolling force will be explained as one embodiment of the learning method in rolling load prediction.

(Step-1) For any stock , as an indicator of the prediction error of rolling force at an actual pass, an error rate $C^P$ between an actual value of rolling force at an actual pass and the calculated value of rolling force at the actual pass is found based on formula (1).

Here, as explained above, the "calculated value of the rolling force" means the rolling force, obtained by entering the actual values of the rolling conditions of the pass into a prediction formula of rolling force, multiplied with a learning coefficient of rolling force prediction for that pass.

(Step-2) For the stock, the rolling force $P^{cal}$ at a predicted pass performed after this is calculated using a rolling force model.

(Step-3) For the stock, a gain α is found according to the thickness of the stock at the exit side of the rolling pass for which the rolling force was predicted at the above (Step-2). At this time, preferably the gain α is set to become larger, the greater the delivery thickness at the predicted pass of the stock. Note that, as the thickness of the stock, the entry thickness at the predicted pass, the entry thickness or delivery thickness at the actual pass, the delivery thickness at the final pass, etc. may be referred to so as to change the gain α.

(Step-4) From the gain a calculated at the above (Step-3) and the prediction error rate $C^P$ of the rolling load at the actual pass found at the above (Step-1), formula (2) is used to calculate the learning coefficient $C^F$ of the rolling force at the predicted pass. Here, $C^{F'}$ is the learning coefficient of the rolling force at the actual path at the above (Step-1).

$$C^F=\alpha\cdot C^P+(1-\alpha)\cdot C^{F'} \tag{2}$$

(Step-5) Using the predicted value $P^{cal}$ of the rolling force predicted at the above (Step-2) and the learning coefficient $C^F$ of the rolling force calculated at the above (Step-4), formula (3) is used to calculate the prediction of the rolling force for setting $P^{set}$ at the predicted pass.

$$P^{set}=C^F\cdot P^{cal} \tag{3}$$

(Step-6) Based on the prediction of the rolling force for setting $P^{set}$ calculated at the above (Step-5), the rolling conditions at the rolling pass are set and rolling performed.

Above, the process of learning of a rolling load in an embodiment of the present invention was shown, but in the present embodiment, the gain multiplied with the precision of the rolling load prediction is adjusted in an actual pass in the rolling load prediction in accordance with the magnitude of the thickness of the stock, so it is possible to improve the precision of the rolling load prediction more stably than the past. Further, due to this, the thickness, crown, and flatness of the rolled products can be made closer to the desired values, so the advantageous effects are obtained that the yield loss in rolling is suppressed and the productivity is improved.

EXAMPLE 1

Below, an example of the present invention will be explained based on the drawings. Note that, the numerical values, functions, etc. used in the following examples are nothing more than illustrations for explaining the present invention. The present invention is not limited to the following examples. Note that component elements having substantially the same functional configurations in the Description and Drawings are assigned the same reference signs and overlapping explanations are omitted.

Consider an example applying the present invention to inter-pass learning for rolling force prediction and rolling torque prediction in reverse multi-pass type rolling by a rolling mill 1 shown in FIG. 1. In the rolling mill 1, the stock 2 has already been rolled by an (i−1)-th pass and is about to be rolled at an i-th pass. At this time, the rolling force $P^{exp}_{i-1}$ and rolling torque $G^{exp}_{i-1}$ at the (i−1)-th pass and the entry thickness $H_{i-1}$, the delivery thickness $h_{i-1}$, and the rolling temperature $T_{i-1}$ of the stock 2 are stored in the processing unit 3. Further, the processing unit 3 stores the work roll radius R of the rolling mill 1 and the material components of the stock and width w of the stock 2

Below, the case will be shown of referring to the prediction error rates of the rolling force and rolling torque at the (i−1)-th pass to correct the predicted values of the rolling force and rolling torque at the i-th pass.

The processing unit 3 first calculates the deformation resistance $k_{i-1}$ at an actual pass of the stock 2, that is, the (i−1)-th pass. In general, the deformation resistance $k_{i-1}$ at the (i−1)-th pass is given by a function using at least the material components of the stock and rolling temperature $T_{i-1}$ of the rolling material as arguments.

Next, the processing unit 3 will be used to calculate the flattened roll radius $R'_{i-1}$ at the (i−1)-th pass. In the present example, formula (4) was used.

$$R' = \left(1 + \frac{C_H \cdot P}{w(H-h)}\right)R \tag{4}$$

Here, $C_H$ is the Hitchcock coefficient. Further, H and h are the entry and delivery thicknesses of the pass, while P is the rolling force at the pass. Here, the entry thickness $H_{i-1}$, delivery thickness $h_{i-1}$, and actual force $P^{exp}_{i-1}$ at the (i−1)-th pass were inputted.

Furthermore, the processing unit 3 is used to use formulas (5) and (5)' to calculate the calculated value $P^{cal}_{i-1}$ of the rolling force and the calculated value $G^{cal}_{i-1}$ of the rolling torque at the (i−1)-th pass.

$$P^{cal} = Q \cdot k \cdot \sqrt{R'(H-h)} \cdot w \tag{5}$$

$$G^{cal} = \lambda \cdot \sqrt{\frac{(H-h)}{R'}} \cdot R \cdot P^{cal} \tag{5'}$$

Here, Q is the rolling force function at the pass, while λ is the torque arm coefficient. Furthermore, from the actual measured value $P^{exp}_{i-1}$ of the rolling force at the (i−1)-th pass and the calculated value $P^{cal}_{i-1}$ of the rolling force at the (i−1)-th pass, based on formula (1), the error rate $C^P(P)$ of the rolling force at the actual pass ((i−1)-th pass) is found. Similarly, from the actual measured value $G^{exp}_{i-1}$ of the rolling torque at the (i−1)-th pass and the calculated value $G^{cal}_{i-1}$ of the rolling torque at the (i−1)-th pass, based on formula (1), the error rate $C^P(G)$ of the rolling torque at the actual pass ((i−1)-th pass) is found.

Next, from the rolling conditions for the i-th pass of the predicted pass of the rolling material 2, the predicted values of the rolling force and rolling torque at the predicted pass are calculated. This can be found by inputting the i-th pass entry thickness Hi, delivery thickness hi, rolling temperature Ti, etc. into formulas (4) to (5)'.

Furthermore, referring to formula (6), for setting the learning coefficient for rolling load prediction, the gain α multiplied with the prediction error rates of the rolling force and rolling torque at an actual pass is found. In the present example, as shown in formula (6), the gain α was changed in accordance with the delivery thickness h of the predicted pass (i-th pass).

$$\alpha = \begin{cases} 2.5 \times 10^{-1} & (h \le 10) \\ 1.0 \times 10^{-2} h + 1.5 \times 10^{-1} & (10 < h \le 60) \\ 7.5 \times 10^{-1} & (60 < h) \end{cases} \tag{6}$$

Figure 2:
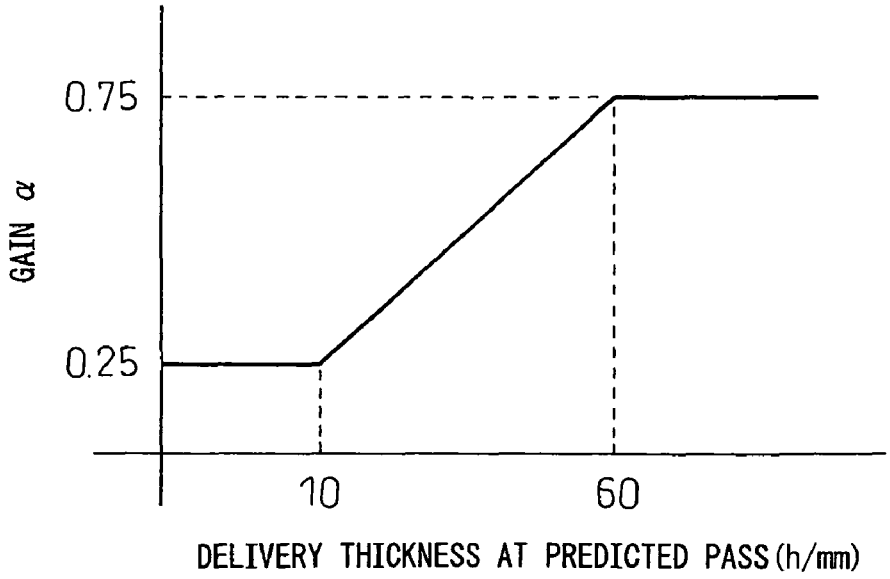
FIG. 2 is a graph showing the relationship between the delivery thickness h and gain a used in Example 1 of the present invention.

Here, the unit of the delivery thickness at the predicted pass h is mm. Note that, the relationship between the delivery thickness at the predicted pass h and the gain α based on formula (6) is shown in FIG. 2 as well.

Finally, the gain α determined by the formula (6) is used with formula (2) to calculate the learning coefficient $C^F(P)$ of the rolling force and the learning coefficient $C^F(G)$ of the rolling torque at the predicted pass. Based on this and the predicted value $P^{cal}$ of the rolling force and the predicted value $G^{cal}$ of the rolling torque, formula (3) is used to calculate the prediction of the rolling force for setting $P^{set}$ and the prediction of the rolling torque for setting $G^{set}$ at the i-th pass.

When using the formula (3) when calculating the prediction of the rolling torque for setting $G^{set}$, it is possible to enter the predicted value of the rolling torque $G^{cal}$ instead of the predicted value of the rolling force $P^{cal}$ and enter the learning coefficient $C^F(G)$ of the rolling torque instead of the learning coefficient $C^F(P)$ of the rolling force.

By setting the roll gap, crown control amount, and rolling speed based on the prediction of the rolling force for setting $P^{set}$ and the prediction of the rolling torque for setting $G^{set}$ found at formula (3), the stock 2 is rolled by the i-th pass.

In this way, when predicting the rolling force and rolling torque at a rolling pass to be performed from, then (predicted pass) based on the rolling force at an actually performed rolling pass (actual pass) and also the actual value and the calculated value of the rolling torque, the gain multiplied with the rolling force prediction error rate and rolling torque prediction error rate of the rolling force prediction and rolling torque prediction at the actual pass was changed in accordance with the delivery thickness of the stock 2 at the predicted pass.

As a comparative example, the gain was made constant (α=0.5) regardless of the delivery thickness of the stock 2 at the predicted pass and the prediction errors of the rolling force and rolling torque were compared. Note that this was applied to rolling of 100 units for comparison.

Figure 3:
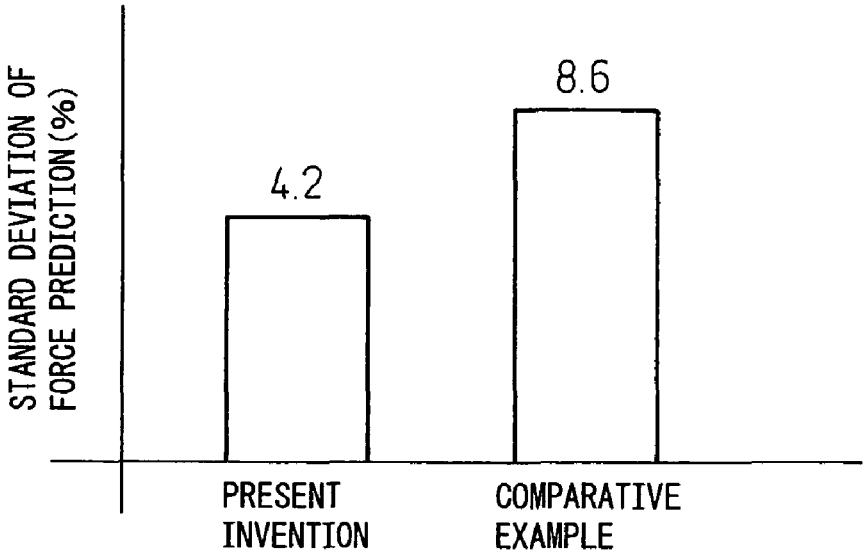
FIG. 3(*a*) is a graph showing the precision of the rolling force prediction, when predicting the rolling force as the rolling load, in Example 1 of the present invention.
Figure 3:
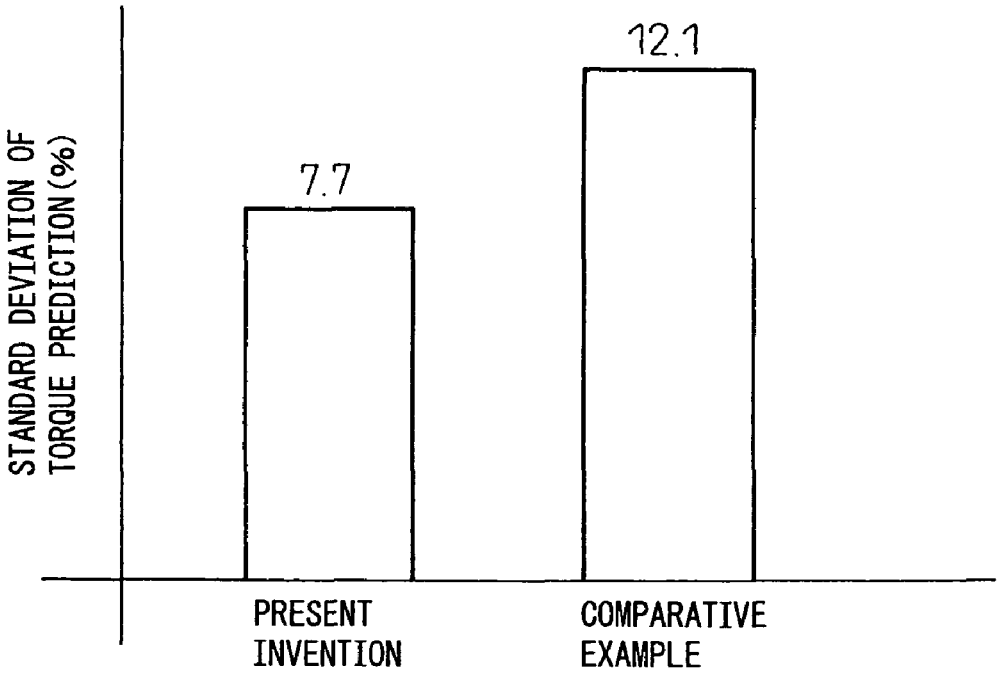

The results are shown in FIG. 3(*a*) and FIG. 3(*b*). In the comparative example, the standard deviation σ of rolling force prediction was 8.6% and the standard deviation σ of rolling torque prediction was 12.1%, while in the present example, the standard deviation σ of rolling force prediction was 4.2% and the standard deviation σ of rolling torque prediction was 7.7%, that is, values greatly reduced from the comparative example. Due to this, in the present example, the precision of the rolling force prediction and rolling torque prediction was improved, so it was possible to precisely set the roll gap, crown control amount, and rolling speed at each rolling pass and therefore the precision of thickness, crown, and flatness of the rolled products could be greatly improved.

Here, the explanation was given of the example of the case of use of the rolling force and rolling torque for the indicators to be predicted, but the present invention is not limited to prediction of the rolling force and rolling torque. For example, it may also be applied to prediction of the rolling power and other various rolling load indicators. That is, the present invention is not limited to the above examples. The rolling load indicators may be changed in various ways within a scope not exceeding the gist of the invention.

Further, in the present example, the explanation was given as an example of the case of use of the actual result in the immediately preceding rolling pass to improve the precision of the rolling load prediction in the immediately succeeding rolling pass, but, for example, the present invention may also be applied to the case of using not only the actual result in the immediately preceding rolling pass, but also the actual result of an already performed single rolling pass, or two or more rolling passes and/or the case of improving not only the precision of the rolling load prediction at the immediately succeeding rolling pass, but also that of a subsequently performed single rolling pass or, two or more rolling passes.

In addition, in the present example, the explanation was given of the example of the case of referring to the delivery thickness of the stock at the predicted pass, but the present invention is not limited to the delivery thickness of the stock at the predicted pass, for example, the entry thickness at the predicted pass, the entry thickness or delivery thickness at the actual pass, the delivery thickness at the final pass, or a combination of the same etc. may also be used.

EXAMPLE 2

Example 2, like Example 1, applies the present invention to inter-pass learning of rolling force prediction in reverse type multi-pass rolling by the rolling mill 1 shown in FIG. 1. In the present example, as shown in formula (7), the gain α was changed in accordance with the referred to the delivery thickness h at the actual pass.

$$\alpha = \begin{cases} 0.2 & (h < 10) \\ 0.3 & (10 \le h < 15) \\ 0.4 & (15 \le h < 30) \\ 0.5 & (30 \le h < 50) \\ 0.6 & (50 \le h < 75) \\ 0.7 & (75 \le h < 100) \\ 0.8 & (100 \le h) \end{cases} \tag{7}$$

Figure 4:
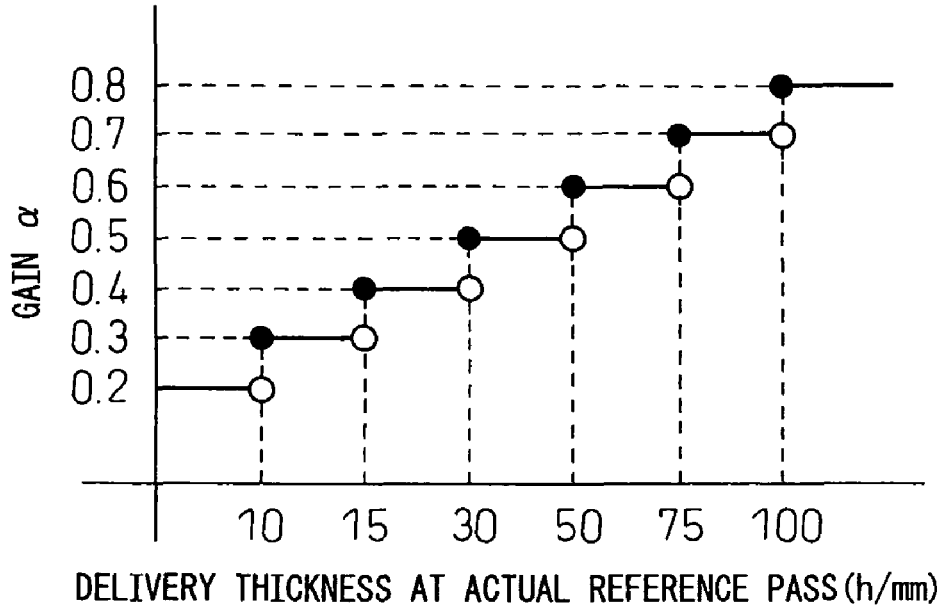
FIG. 4 is a graph showing the relationship between the delivery thickness of the actual pass h and a gain α used in Example 2 of the present invention.

Note that, the relationship between the delivery thickness h at the actual pass and gain α based on formula (7) is shown in FIG. 4 as well. Further, at each rolling pass, the learning coefficient at the rolling force prediction at the following rolling passes was updated so as to correct the draft schedule and crown control amount at the subsequent passes. In this way, a hot steel plates were rolled with initial thickness of 40.0 to 200.0 mm, delivery thickness at the final pass of 4.0 to 150.0 mm, a width of 1200 to 4800 mm, and a total number of rolling passes of 4 to 15.

As a comparative example, the gain was made constant (α=0.5) regardless of the delivery thickness of the stock 2 at the actual and rolling performed in a similar way. Note that, this was applied to 100 rolling materials.

Figure 5:
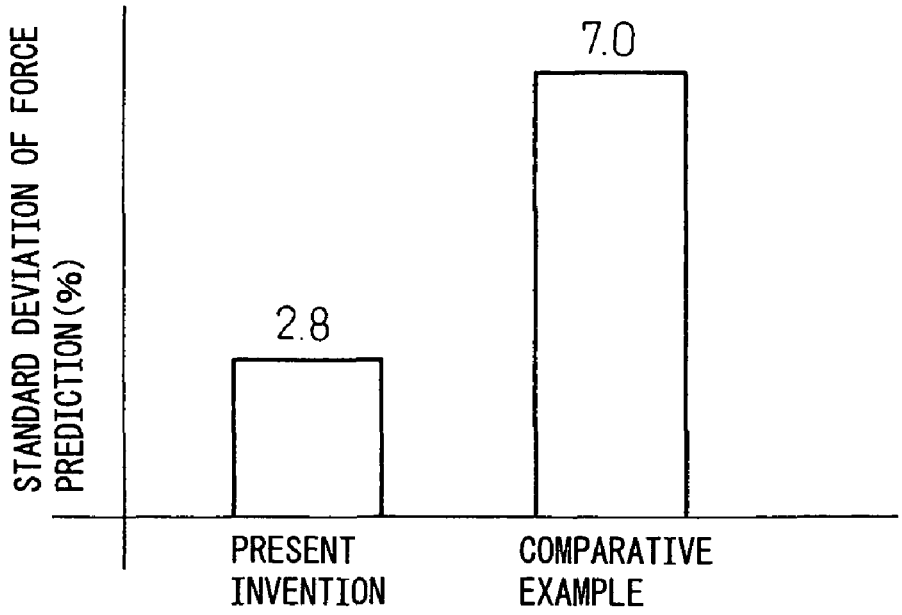
FIG. 5 is a graph showing the precision of the rolling force prediction in Example 1 of the present invention.

As a result, as shown in FIG. 5, in the comparative example, the standard deviation of rolling force prediction σ was 7.0%, while in the present example, the standard deviation of rolling force prediction σ was 2.8%. Much reduced from the comparative example.

Figure 6:
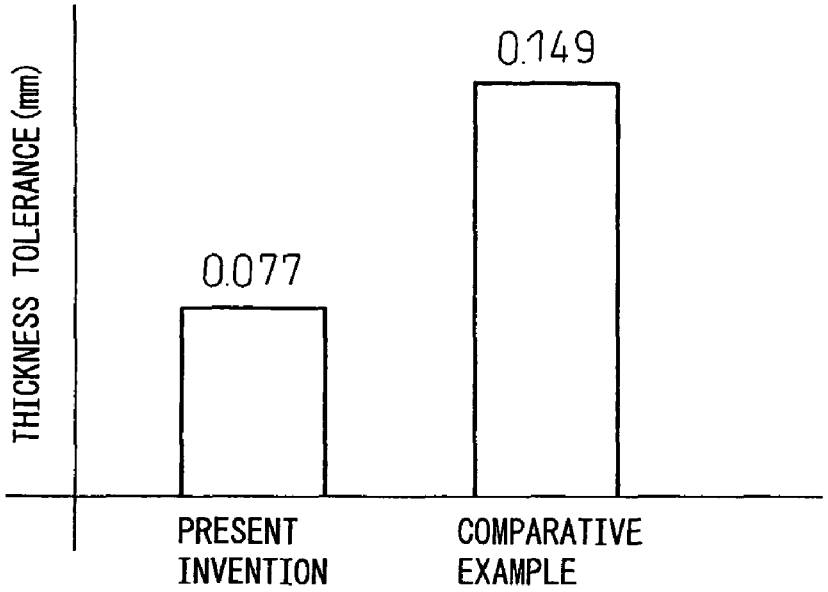
FIG. 6 is a graph showing the thickness tolerance in Example 2 of the present invention.

Further, in the present example, the precision of the rolling force prediction was improved, so it was possible to precisely set the roll gap and crown control amount at each rolling pass, therefore, as shown in FIG. 6, delivery thickness tolerance of the stock at the final pass (average of the variation from target value) was 0.149 mm in the comparative example, while was greatly improved to 0.077 mm in the present example.

Figure 7:
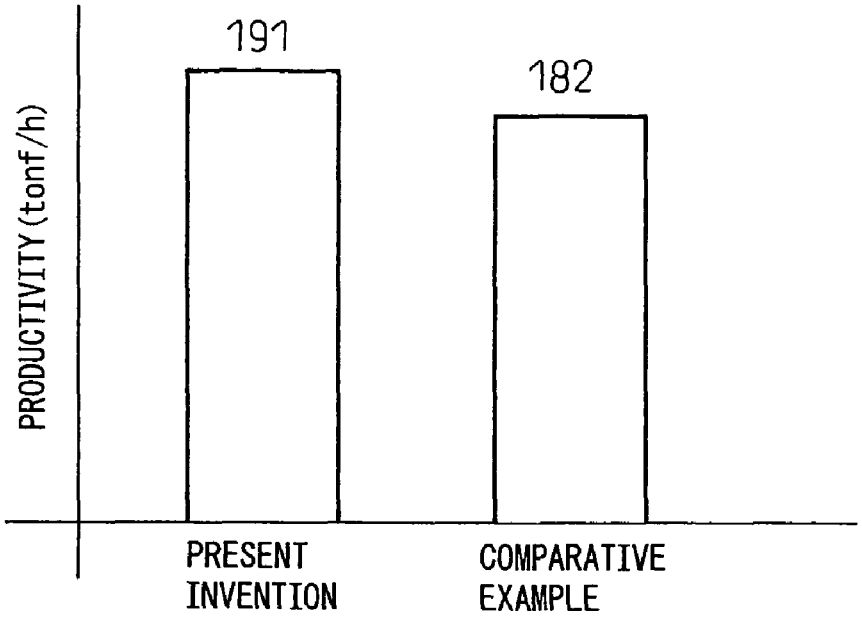
FIG. 7 is a graph showing the productivity in Example 2 of the present invention.

Furthermore, due to the improvement of precision of the rolling force prediction, the crown tolerance was also improved, so the flatness could be greatly improved and the rate of occurrence of troubles due to poor flatness could be greatly reduced, so, as shown in FIG. 7, the productivity (amount of rolling products per hour) was 182 tonf/h in the comparative example, while was improved to 191 tonf/h in the present example.

EXAMPLE 3

Example 3 is an example of application of the present art to a tandem rolling process of hot strip with a final stand delivery thickness of 1.0 to 20.0 mm.

Figure 8:
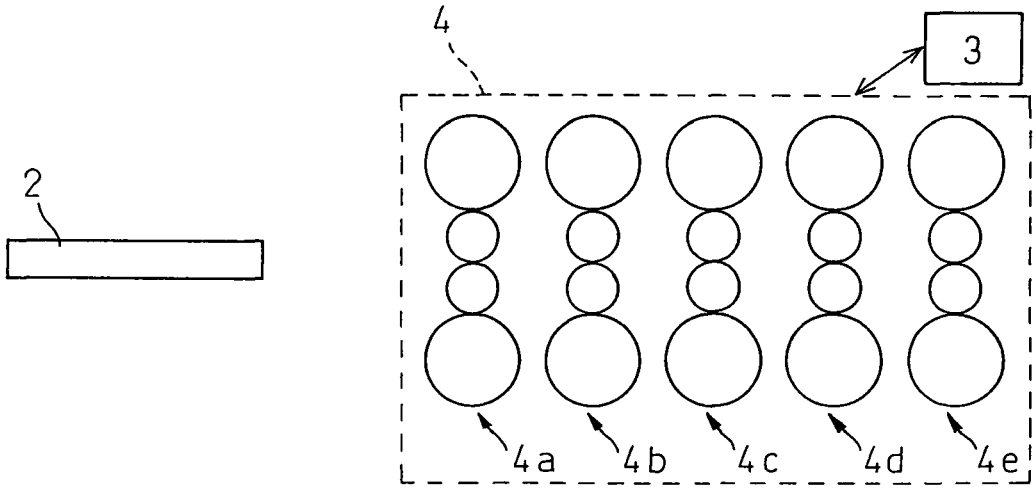
FIG. 8 is a view showing a rolling line used in Example 1 of the present invention.

As shown in FIG. 8, consider the example of application of the present invention to inter-pass learning of rolling force prediction in tandem rolling in a group of rolling mills 4 comprised of five rolling mills 4*a* to 4*e*. In the group of rolling mills 4, the stock 2 is already rolled by the first stand 4*a* and is about to be rolled by the second stand 4*b* to the fifth stand 4*e*. At this time, the rolling force $P^{exp}_1$ at the first stand, the entry thickness $H_1$ of the stock 2, the delivery thickness $h_1$, and the rolling temperature $T_1$ are stored in the processing unit 3. Further, the processing unit 3 also stores the work roll radius R of the stands 4*a* to 4*e* of the group of rolling mills 4 and the material components and width w of the stock 2.

Here, it may be considered to use the prediction error of rolling force at the first stand to correct the predicted value of the rolling force at the second to fifth stands.

The processing unit 3, first, calculates the material deformation resistance $k_1$ at the first stand of the stock 2. Next, the processing unit 3 is used to calculate the flattened roll radius $R'_1$. Furthermore, the processing unit 3 is used to calculate, by formula (5), the calculated value of the rolling force $P^{cal}_1$. Finally, it finds the error rate $C^P$ of the rolling force from the actual measured value of the rolling force $P^{exp}_1$ and the calculated value of the rolling force $P^{cal}_1$ based on formula (1) and calculates the learning coefficient of rolling force prediction $C^F$ at the subsequent rolling passes by formula (2).

Next, the unit calculates the predicted value of the rolling force at subsequent rolling stands for rolling the stock 2 from the rolling conditions for the rolling stand. This can be found, as shown in Example 1, by inputting the entry thickness $H_i$, delivery thickness $h_i$, and rolling temperature $T_i$ (suffix i shows value is for i-th stand, same below), etc. for each stand into formulas (4) to (5).

Furthermore, based on the delivery thickness $h_i$ of each stand, it refers to formula (8) and finds the gain α for multiplication with the prediction error of the rolling force rate at an actual pass for the rolling force prediction for each stand. In the present example, the gain α was changed in accordance with delivery thickness at the fifth stand h.

$$\alpha = \frac{1}{2}\left\{1 + \sin\left(\frac{\pi}{30}h - \frac{\pi}{2}\right)\right\} \tag{8}$$

Figure 9:
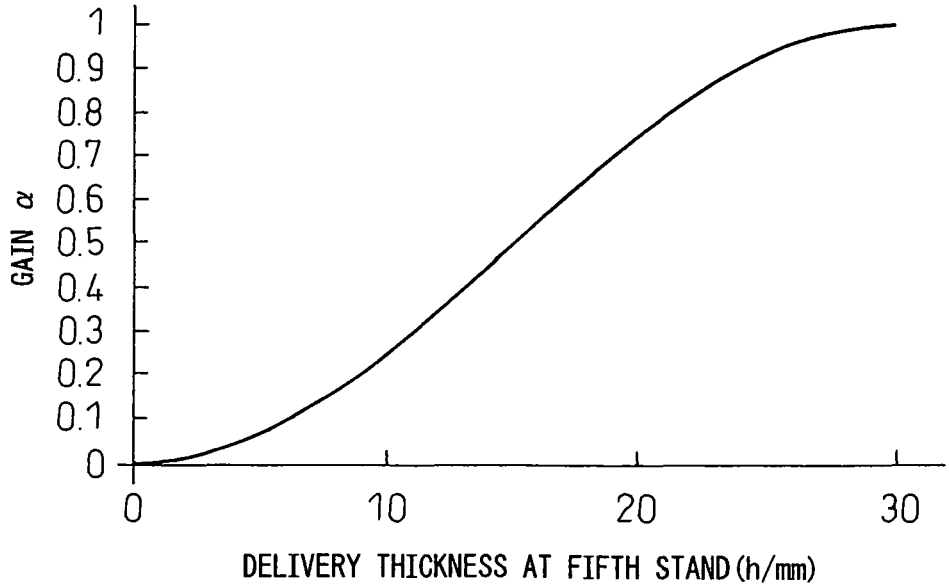
FIG. 9 is a graph showing the relationship between the delivery thickness at fifth stand h and a gain α used in Example 3 of the present invention.

Here, the unit of the delivery thickness at the fifth stand h is mm. Note that, the relationship of the delivery thickness at the fifth stand h and the gain α based on formula (8) is shown in FIG. 9.

Finally, the gain α determined at formula (8) was used to correct the predicted value of the rolling force $P^{cal}$ so as to calculate the prediction of the rolling force for setting $P^{set}$ based on formula (3). By setting the roll gap and crown control amount based on the prediction of the rolling force for setting $P^{set}$ obtained, the stock 2 was rolled at the second stand 4*b* to fifth stand 4*e* of the group of rolling mills 4.

As a comparative example, the learning gain was made constant (α=0.3) regardless of the delivery thickness at the fifth stand of the stock 2. Note that, this was applied to 200 rolling materials each.

As a result, in the comparative example, the standard deviation of rolling force prediction σ was 3.1%, while in the present example, the standard deviation of rolling force prediction σ was greatly improved to 1.9%.

INDUSTRIAL APPLICABILITY

According to the present invention, in hot rolling, it is possible to improve the precision of the rolling load prediction more stably than the past. Further, due to this, it is possible to make the thickness, crown, and flatness of the rolled products closer to the desired values, so the effects are also obtained that the yield loss in rolling is suppressed and the productivity is improved. For this reason, the present invention will contribute to the efficient production of ferrous metal materials and will of course have ripple effects not only in the ferrous metal industry of course, but also the automobile industry etc. using a broad range of ferrous metal products.

| List of references | |
|---|---|
| 1. | rolling mill |
| 2. | stock |
| 3. | processing unit |
| 4. | group of rolling mills |
| 4a. | first stand of group of rolling mills 4 |
| 4b. | second stand of group of rolling mills 4 |
| 4c. | third stand of group of rolling mills 4 |
| 4d. | fourth stand of group of rolling mills 4 |
| 4e. | fifth stand of group of rolling mills 4 |

The invention claimed is:

1. A learning method of rolling load prediction for hot rolling, using a prediction error of a rolling load at an actual pass of a stock to correct a predicted value of rolling load at a rolling pass of said stock to be performed subsequent to said actual pass, said learning method of rolling load prediction for hot rolling characterized by, when setting a learning coefficient for rolling load prediction, making a gain for multiplying with the prediction error of the rolling load at said actual pass smaller, the smaller a thickness of the stock, wherein $C^P$ denotes said prediction error rate of rolling load at said actual rolling pass, $C^F$ denotes said learning coefficient, $\alpha$ denotes said gain, said method comprising:

a) determining said prediction error rate $C^P$ of rolling load at said actual rolling pass;

b) determining fro said subsequently performed rolling pass a calculated rolling load $P^{cal}$ using a rolling load model;

c) determining said gain $\alpha$ according to a thickness of the stock;

d) determining said learning coefficient $C^F$ using said gain $\alpha$ obtained in step c) and said prediction error rate $C^P$ obtained in step a), said learning coefficient $C^F$ of the rolling load at said subsequently performed rolling pass is calculated using formula (2)

$$C^F=\alpha\cdot C^P+(1-\alpha)\cdot C^{F'} \quad (2)$$

wherein $C^{F'}$ is a learning coefficient of said rolling load at said actual rolling pass; and e) obtaining a predicted rolling load $P^{set}$ for said subsequently performed rolling pass based on said calculated rolling load $P^{cal}$ obtained in step b) and said learning coefficient $C^F$ obtained in step d).

2. The method of claim 1, wherein in step a) said prediction error rate $C^P$ is determined based on an actual rolling load $P^{exp}$ at said actual rolling pass and a calculated rolling load $P^{cal'}$ at said actual rolling pass according to formula (1), wherein said calculated rolling load $P^{cal'}$ is obtained based on actual values of rolling conditions of said actual rolling pass $$C^p = \frac{P^{exp}}{P^{cal'}}. \quad (1)$$

3. The method of claim 1, wherein in step e) said predicted rolling load $P^{set}$ for said subsequently performed rolling pass is determined based on $P^{cal}$ and $C^F$ according to formula (3)

$$P^{set}=C^F\cdot P^{cal} \quad (3).$$

4. The method of claim 1, wherein said rolling load is selected from the group consisting of rolling force, rolling torque, and rolling power.

5. The method of claim 1, wherein said thickness is selected from the group consisting of an entry thickness, a delivery thickness, and an average thickness at said subsequent rolling pass.

6. A learning method of rolling load prediction as set forth in claim 1, characterized by changing the gain for multiplying with the prediction error of the rolling load at said actual pass in accordance with the thickness of the stock at an actual pass.

7. A learning method of rolling load prediction as set forth in claim 1, characterized by changing the gain for multiplying with the prediction error of the rolling load at said actual pass in accordance with the thickness of the stock at the predicted pass.

8. A learning method of rolling load prediction as set forth in claim 1, characterized by changing the gain for multiplying with the prediction error of the rolling load at said actual pass in accordance with the thickness of the stock at a final pass.

9. A learning method of rolling load prediction as set forth in any one of claims 1 and 6 to 8, characterized in that the thickness used for changing the gain multiplied with the prediction error of the rolling load at said actual pass is one obtained from one or more of an entry thickness, delivery thickness, and average thickness in combination.

10. A learning method of rolling load prediction as set forth in any one of claims 1 and 6 to 8, characterized in that said rolling load is a rolling force.

11. A learning method of rolling load prediction as set forth in any one of claims 1 and 6 to 8, characterized in that said rolling load is a rolling torque.

* * * * *

UNITED STATES PATENT AND TRADEMARK OFFICE

CERTIFICATE OF CORRECTION

PATENT NO. : 8,185,232 B2
APPLICATION NO. : 12/451037
DATED : May 22, 2012
INVENTOR(S) : Tsuyoshi Higo et al.

It is certified that error appears in the above-identified patent and that said Letters Patent is hereby corrected as shown below:

On the Title page, Item [30] Foreign Application Priority Data, change "2007-066712" to -- 2008-066712 --.

Signed and Sealed this
Twenty-fourth Day of December, 2013

Margaret A. Focarino

Margaret A. Focarino
*Commissioner for Patents of the United States Patent and Trademark Office*